US006139130A

United States Patent [19]

Takahashi et al.

[11] Patent Number: 6,139,130

[45] **Date of Patent: *Oct. 31, 2000**

[54] SUBSTRATE AND LIQUID JET RECORDING HEAD WITH PARTICULAR ELECTRODE AND RESISTOR STRUCTURES

[75] Inventors: Hiroto Takahashi, deceased, late of Sakata, by Ishigorou Takahashi, Kiku Takahashi, executors; Yasuyuki Tamura; Mineo Kaneko, both of Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/653,990

[22] Filed: May 28, 1996

Related U.S. Application Data

[63] Continuation of application No. 08/171,601, Dec. 22, 1993, abandoned.

[30] Foreign Application Priority Data

Dec. 22, 1992 [JP] Japan ..... 4-342162

[51] Int. Cl.[7] ..... B41J 2/05

[52] U.S. Cl. ..... 347/62; 347/208; 347/58; 338/308; 338/333

[58] Field of Search ..... 347/62, 58, 208, 347/206; 338/309, 308, 333

[56] References Cited

U.S. PATENT DOCUMENTS

| | | | |
|---|---|---|---|
| 2,621,276 | 12/1952 | Howland | 29/621 |
| 4,385,226 | 5/1983 | Sauer | 338/309 X |
| 4,602,261 | 7/1986 | Matsuda et al. | 347/58 |
| 4,631,555 | 12/1986 | Ikeda et al. | 347/58 |
| 4,719,478 | 1/1988 | Tachihara et al. | 347/62 |
| 4,870,433 | 9/1989 | Campbell | 347/62 |
| 4,940,999 | 7/1990 | Ikeda et al. | 347/58 |
| 5,148,191 | 9/1992 | Hasegawa et al. | 347/62 |
| 5,164,747 | 11/1992 | Osada et al. | 347/67 X |

FOREIGN PATENT DOCUMENTS

| | | | |
|---|---|---|---|
| 0371457 | 6/1990 | European Pat. Off. | B41J 2/345 |

*Primary Examiner*—Richard Moses
*Attorney, Agent, or Firm*—Fitzpatrick, Cella, Harper & Scinto

[57] ABSTRACT

A substrate for a recording head includes a heat generating resistor for generating thermal energy to eject liquid, and a pair of opposed electrodes which are electrically connected to the heat generating resistor to supply electric signal to that heat generating resistor. A portion of the heat generating resistor interposed between the electrodes constitutes a heat generating portion, and the electrodes have respective ends adjacent to the heat generating resistor, each of which ends has a smooth convex shape. The width of a pattern constituting the heat generating resistor is greater than a width of a pattern constituting the electrodes.

13 Claims, 11 Drawing Sheets

SUBSTRATE AND LIQUID JET RECORDING HEAD WITH PARTICULAR ELECTRODE AND RESISTOR STRUCTURES

This application is a continuation of application No. 08/171,601, filed Dec. 22, 1993, now abandoned.

FIELD OF THE INVENTION AND RELATED ART

The present invention relates to a liquid jet head and a liquid jet apparatus for erecting liquid by application of thermal energy to liquid such as recording liquid.

In an ink jet recording method, ink (recording liquid) is ejected through an ejection outlet formed in a recording head onto a recording material such as paper. It is advantageous in that the noise level is small, that high speed recording is possible and that there is no need of using special paper, or the like. Recently, various types of recording heads are developed. Among them, a recording head of a type in which thermal energy is applied to the ink to eject the ink, is advantageous in that the responsivity to the recording signal is high and that it is easy to dispose a number of ejection outlets at a high density.

A typical recording head 200 usable with this recording method is shown in FIG. 2 as a perspective view. More particularly, it comprises ejection outlet through which ink is ejected, liquid passages 201 for supplying ink in communication with the ejection outlets 201, heat acting portions 111 in the form of electrothermal transducers having heat generating resistors and wiring electrodes for supplying electric current to the heat generating resistors in the liquid passage 201, a liquid chamber 204 for containing ink to be supplied to the liquid passage 201, disposed upstream of the liquid passages. As desired, protection film or the like may be provided on the electrothermal transducer element to enhance the durability against the ink. Designated by a reference numeral 206 is an ink supply port.

Such a recording head is manufactured through the processes illustrated in FIGS. 6(*a*)–9(*d*). FIG. 6(*a–e*) shows the manufacturing process schematically as cross-sectional views taken along a line A—A' in FIG. 3. First, step (6(*a*), 6(*b*)), a layer 251 (heat generating resistor layer), a part of which is going to establish a heat generating resistor, and a layer 252 (electrode layer), a part of which is going to be a wiring electrode, are formed on a supporting material 253. Subsequently, wiring electrode layer 252 is patterned using photolithographic and etching techniques on a photoresist 254. Then, the heat generating resistor 251 is similarly patterned to provide the heat generating resistor and the wiring electrodes (stop (c)–step 8(*b*).

More particularly, on the workpiece (b) having been subjected to the step 6(*b*), a photoresist 254 such as photosensitive resin or the like is laminated (step 6(*c*)), and the photoresist 254 of the workpiece (c) is exposed to patterned light (step (d)), using a photomask. Subsequently, the photoresist 254 of the workpiece (d) is developed (step 7(*a*)). By the step 6(*e*), unnecessary parts of the photoresist 254 are removed to provide a desired pattern 254*a*. Subsequently, the exposed electrode layer 252 of the workpiece (e) is etched (step 7(*a*)) to remove the remaining resist portion 254*a* of the workpiece (f) (step 7(*b*)). In this manner, a desired pattern 252*a* of the electrode layer 252 is formed.

The pattern of the heat generating resistor 251 is formed through steps similar to that in the case of forming the pattern of the wiring electrode layer 252. More particularly, it includes a laminating step (step 7(*c*)) on the photoresist 254, a pattern exposure step (step 7(*d*)) to the photoresist 254 of the workpiece (h) using a photomask, development of the photoresist 254*b* of the workpiece (i), removing the unnecessary parts (step 8(*a*)), etching the exposed heat generating resistor 251 of the workpiece (j) (step 8(*b*)). Through the process, the pattern 251*a* of the heat generating resistor 251 is formed.

Thereafter, the resist 254 is removed (step 8(*c*)). Subsequently, a protection film 255 is formed for the purpose of providing the durability against the ink (only one layer is shown for the purpose of simplicity of the explanation) (step 8(*d*)). Thereafter, a photosensitive resin material 256 is laminated (step 9(*a*)). Subsequently, it is exposed (step 9(*b*)) and developed (step 9(*c*)), by which a liquid passage wall 203 is formed by a cured film of the photosensitive resin in accordance with the pattern of the exposure and the development (8(*d*)–9(*c*)).

The wall 203 constitutes a wall of the liquid passage to be filled with the ink during the recording operation. Subsequently, a top plate 205 is bonded on the wall 203. Then, ejection side surface is formed by cutting it (not shown). Thus, the ink jet recording head is completed (step 9(*d*)).

Such an ink jet head, however, involves various problem to be solved.

The first problem is step coverage of the protection film.

FIGS. 10(*a*) and (*b*), show electrothermal transducer element of a thermal head. In this case, a width of the heat generating resistor layer 107 is smaller than the wiring electrode 104, and it is easy to lower the step coverage. Since the thermal head does not use electroconductive ink, it is free from corrosion with the ink. Therefore, the step coverage is not a problem. However, as contrasted to the thermal head, the ink jet head uses electroconductive ink during use on the wiring electrode layer 104 and the heat generating resistor layer 107. For this reason, if the step coverage of the protection layer is poor, the electroconductive ink seeps thereinto with the result of the electric corrosion, in conveniently. U.S. Pat. No. 4,602,261 proposes a solution to this problem in which the width of the heat generating resistor layer is made larger than the width of the wiring electrode layer, thus enhancing the step coverage property of the protection layer, in effect. FIG. 10 shows the neighborhood of the heat generating resistor of the thermal head, and FIG. 11 shows the neighborhood of the heat generating resistor disclosed in U.S. Pat. No. 4,602,261.

With this method, the step coverage is improved, but there arises another problem that the heat generation of the heat generating resistor is not uniform as disclosed in U.S. Pat. No. 4,719,478. This is because of the shapes of the wiring electrode layers and the heat generating resistor. U.S. Pat. No. 4,719,478 proposes a shape shown in FIG. 12, with which uniform heat generation of the heat generating resistor is accomplished.

On the other hand, as a material of a heat generating resistor, a material usable without provision of the protection film can be used, as disclosed in U.S. Pat. No. 5,148,191 which has been assigned to the assignee of this application. In addition, the material of the wiring electrode is highly anti-corrosive material such as noble metal. Then, the necessity for the protection layer can be avoided. Even in this case, it is not possible to completely remove the positional deviation between the heat generating resistor and the electrode layer because of the manufacturing tolerances. For this reason, the width of the heat generating resistor is made larger than the width of the wiring electrode layer in the electrode portion to stabilize the quality of the products.

FIG. 12 shows this state, in which, however, inconveniences occur when the size of the heat generating resistor becomes relatively small. More particularly, the positional deviation between the heat generating resistor layer and the wiring electrode layer upon the patterning operation, may be estimated to be the same amount even if the size of the heat generating resistor is reduced. For this reason, the size of the heat generating resistor can not be reduced proportionally, and therefore, the uniform heat generation is difficult. The same thing applies to the case in which the ratio between the length of the heat generating resistor and the width thereof approaches 1. Particularly, when the protection layer is not provided on the heat generating resistor, or when the thickness of the protection layer is relatively small, the heat is diffused by the protection layer, and therefore, is not averaged. Therefore, there is a strong tendency of the local heat generation. This increases the necessity for the uniform heat generation.

SUMMARY OF THE INVENTION

Accordingly, it is a principal object of the present invention to provide a liquid jet head and a liquid jet apparatus having the same which can be easily manufactured without deteriorating the step coverage property of the protection layer and irrespective of the size of the heat generating resistor, and in which the heat generating resistor generated heat uniformly, and which shows good durability.

According to an aspect of the present invention, there is provided a liquid jet head comprising: an ejection outlet for ejecting liquid; an electrothermal transducer for producing thermal energy for ejecting the liquid through the ejection outlet; wherein the electrothermal transducer comprises a heat generating resistor, and a pair of opposite wiring electrodes for supplying electric signal to the heat generating resistor, the wiring electrodes being on the heat generating resistor; wherein the wiring electrodes are provided with expanded portions at opposite ends of the wiring electrodes.

In a heat generating resistor 102 as shown in FIG. 12, the parts at which the current density is excessive large with the result of abnormal heat generation, are at the four corners of the heat generating resistor 102. More particularly, they are the concave part toward the outside (x in the Figure), and they are convex portions at the lateral edges of the opposite ends of the wiring electrode 103 and 104 (Y in the Figure).

According to an aspect of the present invention, the opposing wiring electrodes are extended or expanded so that they are closest at the center. Therefore, adjacent the wiring electrodes, the current density at the four corners of the heat generating resistor can be relatively reduced. For this reason, even if there are concave portion at the corners of the heat generating resistor, the current density at those portions is small, thus preventing overheating. In this embodiment, opposite ends of the wiring or connecting electrodes have small curvatures within the line width at the center of the heat generating resistor, and therefore, the current density is not extremely large at a particular position or positions. Therefore, the uniform heat generation of the heat generating resistor is assured.

Another aspect of this invention involves a substrate for a recording head, which includes a heat generating resistor for generating thermal energy to eject liquid, and a pair of opposed electrodes which are electrically connected to the heat generating resistor to supply electric signal to that heat generating resistor. A portion of the heat generating resistor interposed between the electrodes constitutes a heat generating portion, and the electrodes have respective ends adjacent to the heat generating resistor, each of which ends has a smooth convex shape. The width of a pattern constituting the heat generating resistor is greater than a width of a pattern constituting the electrodes.

Still another aspect of the invention relates to a liquid jet recording apparatus which has a substrate including a heat generating resistor for generating thermal energy to eject liquid, and a pair of opposed electrodes which are electrically connected to the heat generating resistor to supply an electric signal thereto. A portion of the heat generating resistor is interposed between the electrodes to constitute a heat generating portion, and electrodes have respective ends adjacent to the heat generating resistor, each of which ends has a smooth convex shape. An ejection outlet is provided for ejecting the liquid, and a passage is in fluid communication with the ejection outlet, the heat generating portion being disposed in the passage. The width of a pattern forming the heat generating resistor is greater than a width of a pattern forming the electrodes.

Still another aspect of the invention is a liquid jet recording apparatus that includes a substrate having a heat generating resistor for generating thermal energy to eject liquid, a pair of opposed electrodes which are electrically connected to the heat generating resistor to supply an electric signal thereto, a portion of the heat generating resistor being interposed between the electrodes to constitute a heat generating portion, the electrodes having respective ends adjacent to the heat generating resistor, each end having a smooth convex shape, an ejection outlet for ejecting the liquid, and a passage in fluid communication with the ejection outlet, with the heat generating portion is disposed in the passage. A signal supplying means supplies the electric signal. The width of a pattern constituting the heat generating resistor is greater than the width of a pattern constituting the electrodes.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1A:
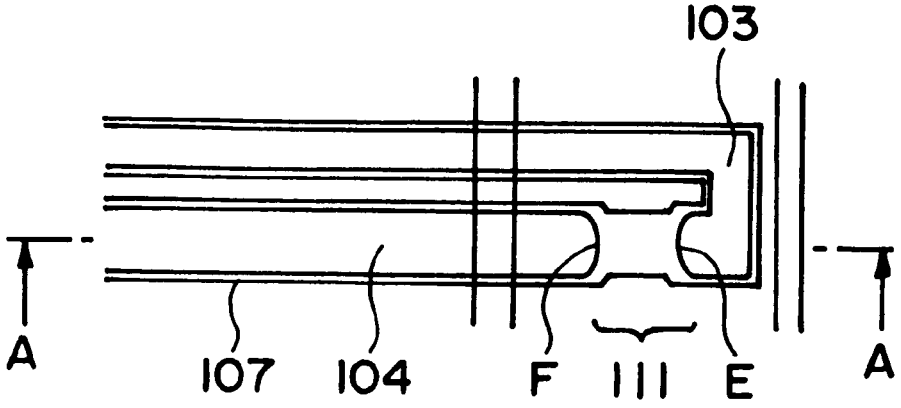
FIG. 1 is a partial enlarged view of a heat generating resistor and a wiring electrode of a head according to an embodiment of the present invention.
Figure 1B:
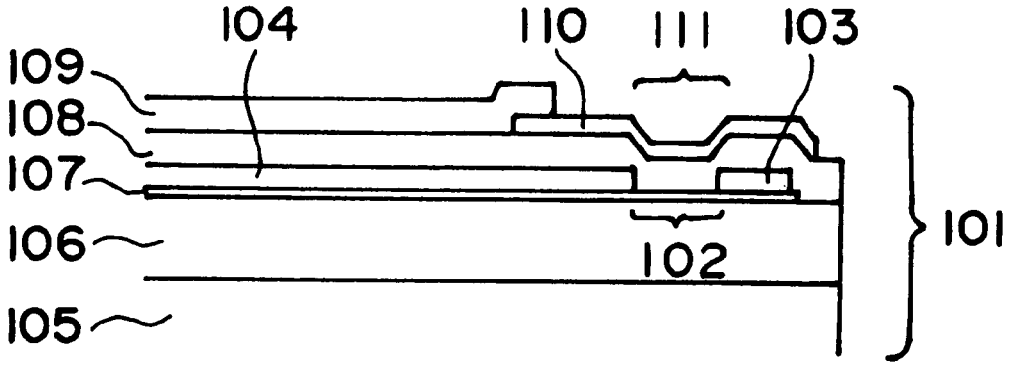
Figure 2A:
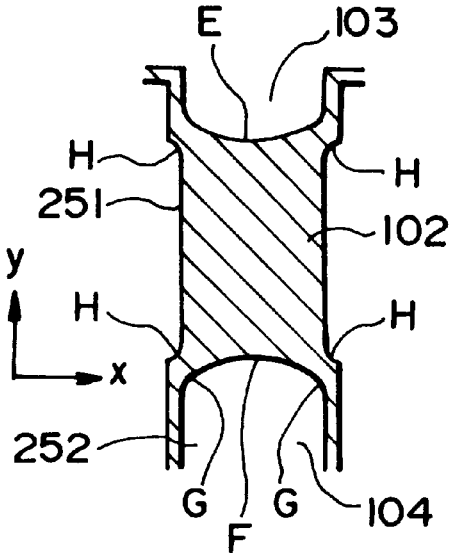
FIG. 2 is a plan view of the heat generating resistor and the wiring electrode.
Figure 2B:
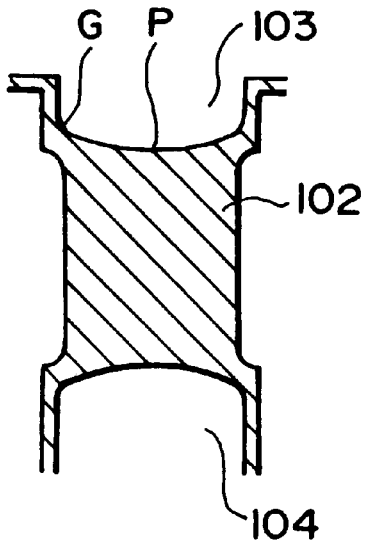
Figure 2C:
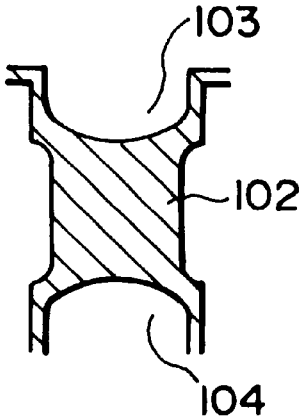
Figure 2D:
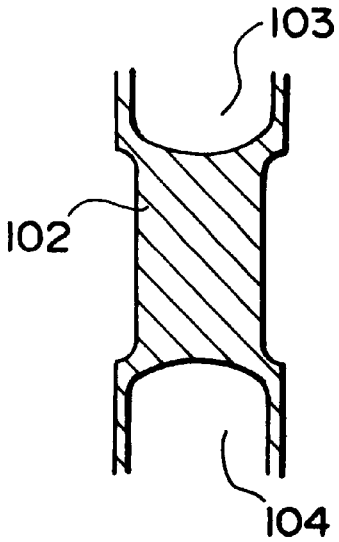
Figure 3:
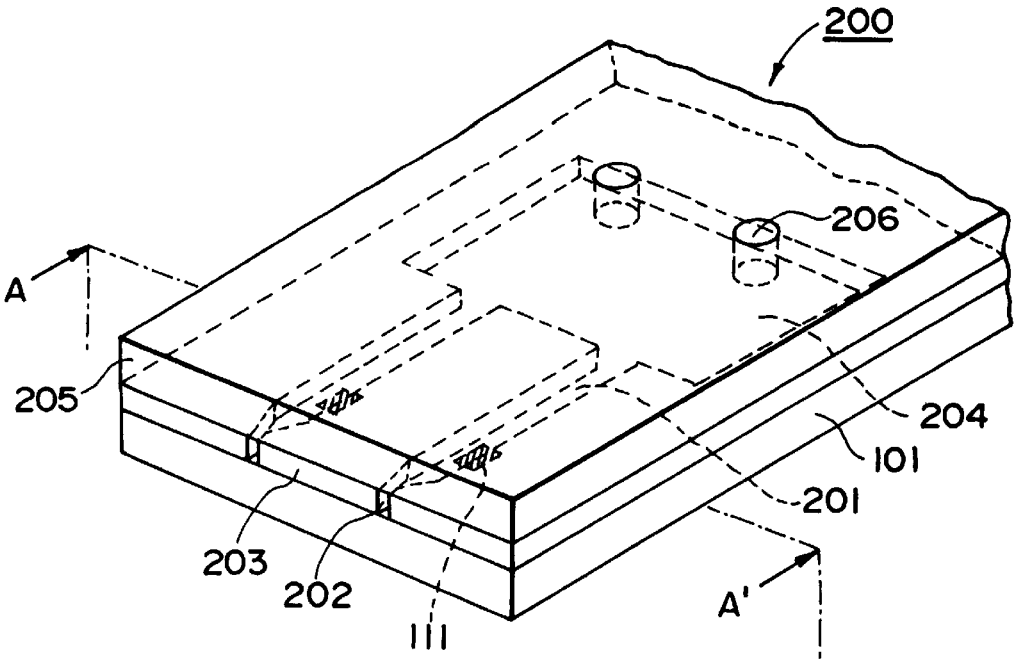
FIG. 3 PRIOR ART
FIG. 3 is a perspective view of a liquid jet head conventional in appearance and suitable for use with the instant invention.

Referring to the accompanying drawings, the embodiments of the present invention will be described. In FIG. 1, (*a*) and (*b*), a structure of the substrate constituting the liquid jet head according to this embodiment is shown. FIG. 2 illustrates the structure in the neighborhood of the heat generating resistor, and FIG. 3 is a perspective view of the liquid jet recording head according to this embodiment. These Figures, designated by reference numerals 101, 102, 103 and 104 are a substrate, a heat generating portion, a common wiring electrode and a selection wiring electrode.

The description will be made as to the manufacturing step of the heat generating resistor substrate according to this invention. First, as shown in FIG. 1, (*a*) and (*b*), an $SiO_2$ film having a thickness of 1.0 μm is formed by heat oxidation of Si wafer (substrate supporting member) 105, the film functions as a lower layer 106 of the substrate 101. On the lower layer 106, a 500 Å-thick heat generating resistor 107 of $HfB_2$ is formed through sputtering.

Subsequently, 50 Å of Ti layer and 5000 Å Al layer are continuously accumulated by electron beam evaporation to form a common wiring electrode 103 and a selection wiring electrode 104. At this time, a circuit pattern shown in FIG. 2(*a*) is formed through a photolithographic process. The heat acting surface of the heat generating resistor portion (heat generating resistor 102) of the heat acting portion 111 has a dimension of 20 μm width and 30 μm length. It has 100 Ω of resistance including the resistances of the both of the wiring electrode 103 and 104 of Al.

Then, as shown in FIG. 1, (*b*), $SiO_2$ as a first upper protection layer 108 is accumulated in a thickness of 1.2 μm over the entire surface of the substrate 101 by a magnetron type high rate sputtering.

After that, as a second upper protection layer 110, 0.15 μm-thickness Ta is laminated through magnetron type high rate sputtering. Subsequently, the second upper protection layer 110 is formed into a pattern covering the top part of the heat generating resistor 102, as shown in FIG. 1, (*b*).

As a third upper protection layer 109, a photosensitive polyimide material (photoneeth, trade name) is applied on the first upper protection layer 108 of the substrate 101, and a pattern is formed through a photolithographic process.

A photosensitive resin dry film of 20 μm thickness is laminated on the substrate 101 thus produced. Then, the exposure development is effected with the use of a predetermined pattern mask, by which liquid passages 201 and a common liquid chamber 204 are formed, as shown in FIG. 3. In addition, a top plate 205 of glass is bonded to the film having the liquid passages 201 or the like by a bonding layer, thus producing the liquid jet recording head. Designated by reference numerals 202, 203 and 206 are ejection outlets, ink liquid passage walls and an ink supply port.

In this embodiment, the liquid passage 201 has a width of 40 μm a height of 20 μm and a length of 150 μm. The length between the front end of the heat acting portion (heater) 111 and the ejection outlet 202, is 50 μm.

The detailed descriptions will be made as to the configuration of the heat generating resistor 102, referring to FIG. 2, (*a*). The wiring electrode 103 and 104 have arcuate extended or expanded portions E and F with a radius R=30 μm and a center on a central axis of the heat generating resistor. The expanded portions E and F are formed at the opposite end portions. In addition at the opposite sides G at the ends of the wiring electrode, where wiring electrodes are faced, an arc having a radius=3 μm is formed in tangent with the above-described arc (R=30 μm). The distance between the electrodes at the more central portion of the wiring than the above-described end portions of the wiring electrode, is 30 μm at minimum. A width of the heat generating resistor 102 measured in a direction perpendicular to the direction in which the wiring electrodes are extended. At the four corners H of the part (resistor width changing portion) where the width is reducing, of the heat generating resistor 102, arcs of R=3 μm are formed, so that the liquid jet recording head shown in FIG. 3 is produced in accordance with this embodiment.

The heat generating resistor 102 of this embodiment provides a larger tolerance against the patterning deviation between the wiring electrode 152 and the heat generating resistor 151. Even in the case that the deviations are ±1 μm in the X axis and Y axis directions, respectively, in FIG. 2(*a*), the electric current density at the portion H is not more than 1.2 times the current density at the central portion of the heat generating resistor.

Another Embodiment

Referring to FIG. 2, (*b*)–(*d*), there is shown another embodiment. The structure and the thickness of the film are the same as the embodiment described in the foregoing.

As shown in FIG. 2(*b*), the expanded portions E and F formed in the central portion of the wiring electrode, are provided with a straight portions P, and an arc having a radius R=30 μm is formed in tangent therewith. Furthermore, a tangent arc having a radius of 3 μm is formed (G).

In FIG. 2, (*c*), a part-ellipse is used for the configuration of the wiring electrode. In FIG. 2(*d*), the arc configuration of the wiring electrode is approximated by a polygonal configuration. However, as described with the foregoing embodiment, the arc configuration is preferable because of the stability.

In any of the embodiments, the configuration of the pattern of the photomask used in the photolithographic process, it involves small pits and projections because of the problem with the manufacturing steps of the photomasks, in many cases. However, such a very small pits and projections do not result in practical problem.

The recording head according to the present invention will be further described.

Figure 4:
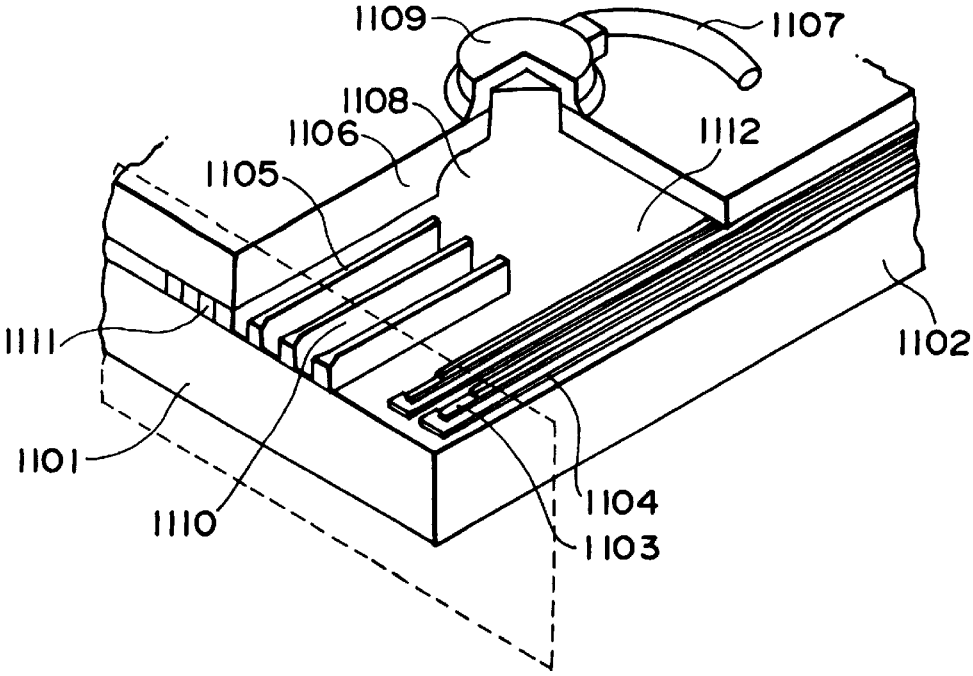
FIG. 4 PRIOR ART
FIG. 4 is a perspective view of a liquid head conventional in appearance and suitable for use with the instant invention.

Referring to FIG. 4, there is shown such an ink jet recording head. It comprises a substrate 1102, electrothermal transducers 1103 formed thereon, electrodes 1104, liquid passage walls 1105 and top plates 1106, manufactured through a semiconductor manufacturing process including etching, evaporation, sputtering or the like. The recording liquid 1112 is supplied into a common liquid chamber 1108 of the recording head 1101 through a liquid supply pipe 1107 from an unshown liquid containing chamber. Designated by a reference numeral 1109 is a connector for a liquid supplying pipe. The liquid 1112 supplied into the common liquid chamber 1108 is supplied to the liquid passages 1110 by capillary force. At the ejection side surface (orifice surface) at the front ends of the liquid passages, meniscuses are formed, so that the liquid is stably retained. Here, by supplying electric energy to the electrothermal transducer 1103, the liquid on the electrothermal transducer surface is abruptly heated, so that a bubble is produced in the liquid passage. By the expansion and collapse of the bubble, the liquid is ejected through the ejection outlet 1111, as a liquid droplet. Using the above-described structure, 128 or 256 ejection outlets can be formed at such a high density that 16 nozzles/mm. In addition, a multi-nozzle ink jet recording head having ejection outlets along the entire recording width, can be manufactured.

Figure 5:
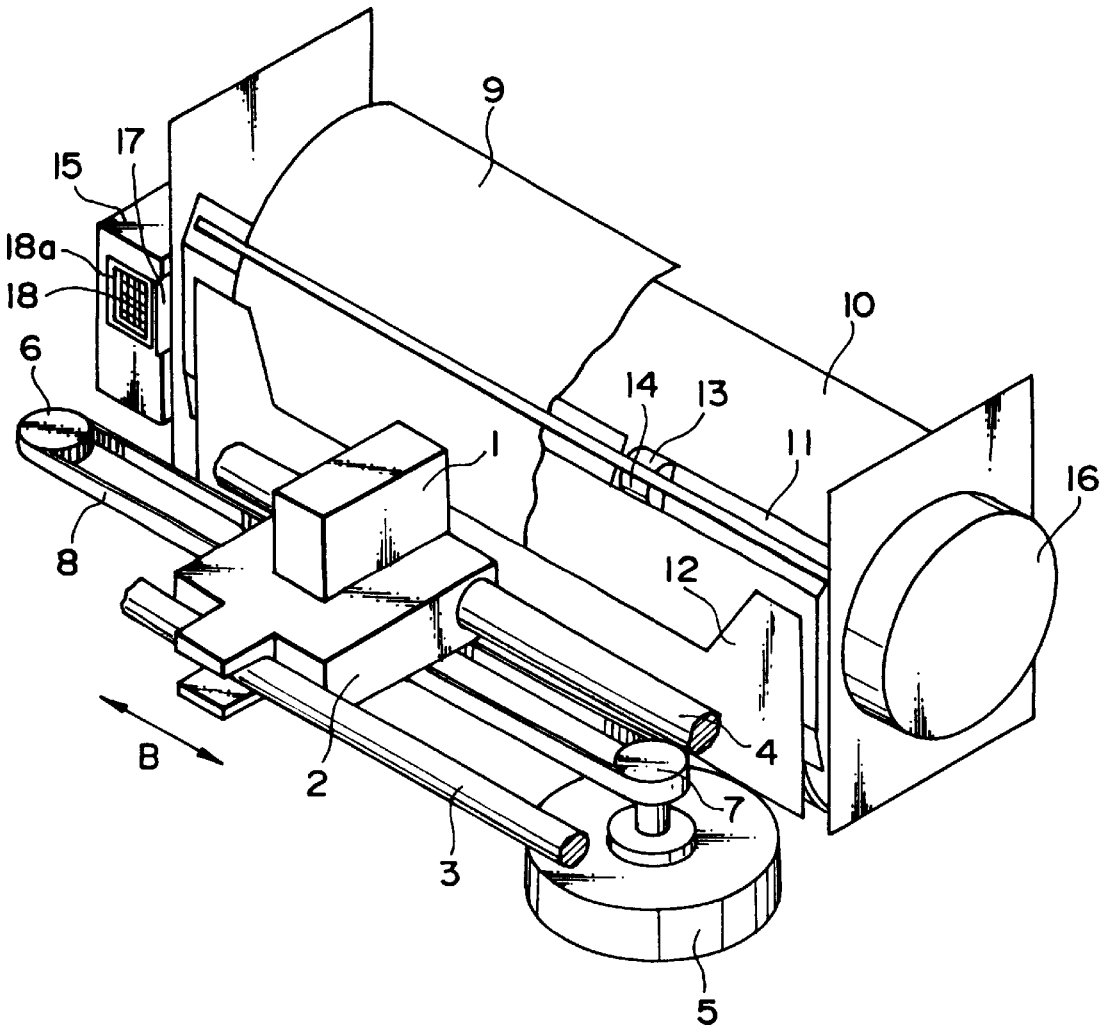
FIG. 5 PRIOR ART
FIG. 5 is a perspective view of a liquid jet apparatus otherwise conventional in appearance and having a recording head according to an embodiment of the present invention, the precise details of the invention not being visible due to the nature and scale of the view.
Figure 6A:
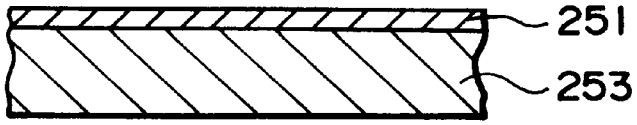
FIG. 6(a) PRIOR ART
FIG. 6 illustrates manufacturing steps of liquid jet head.
Figure 6B:
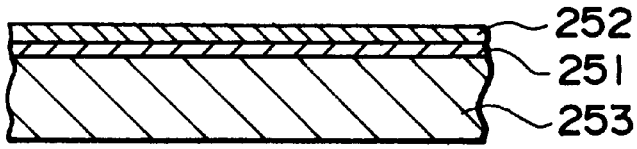
FIG. 6(b) PRIOR ART
Figure 6C:
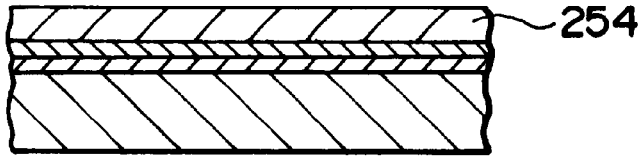
FIG. 6(c) PRIOR ART
Figure 6D:
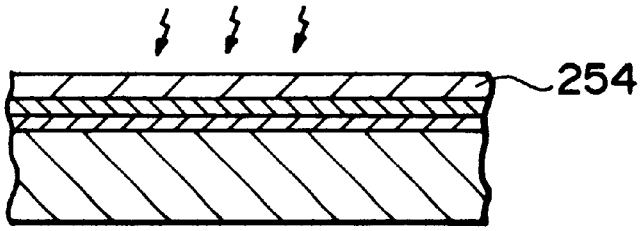
FIG. 6(d) PRIOR ART
Figure 6E:
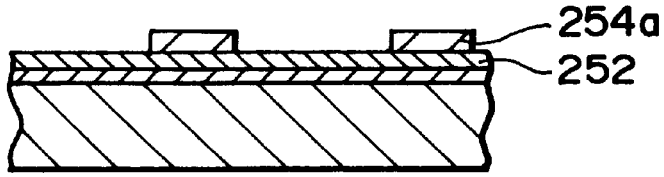
FIG. 6(e) PRIOR ART
Figure 7A:
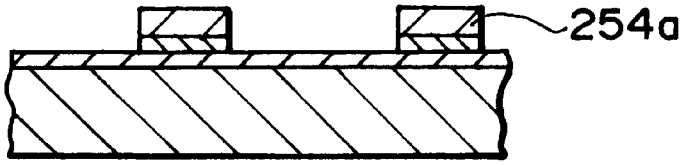
FIG. 7(a) PRIOR ART
FIG. 7 illustrates manufacturing steps of liquid jet head.
Figure 7B:
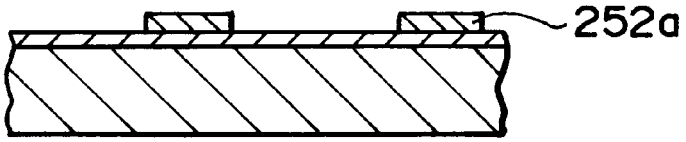
FIG. 7(b) PRIOR ART
Figure 7C:
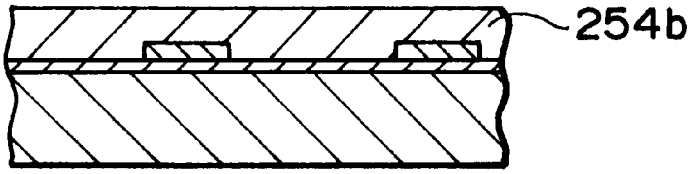
FIG. 7(c) PRIOR ART
Figure 7D:
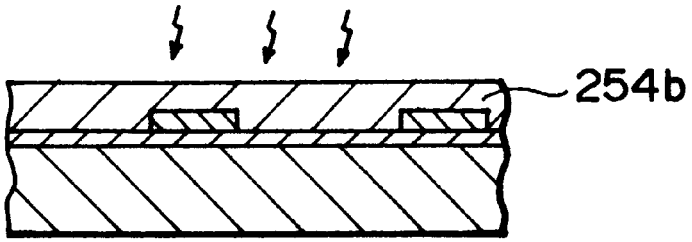
FIG. 7(d) PRIOR ART
Figure 8A:
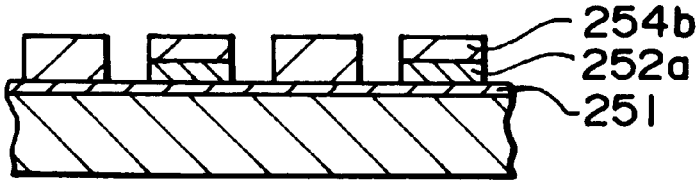
FIG. 8(a) PRIOR ART
FIG. 8 illustrates manufacturing steps of liquid jet head.
Figure 8B:
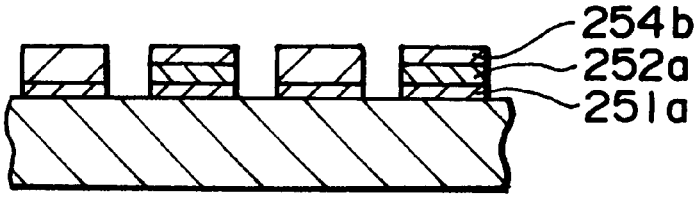
FIG. 8(b) PRIOR ART
Figure 8C:
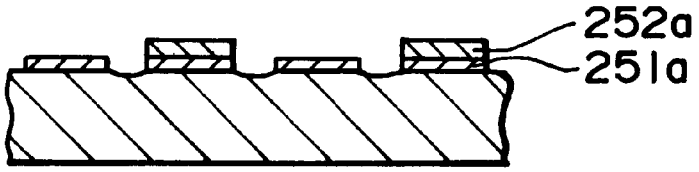
FIG. 8(c) PRIOR ART
Figure 8D:
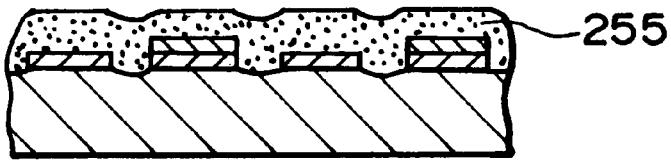
FIG. 8(d) PRIOR ART
Figure 9A:
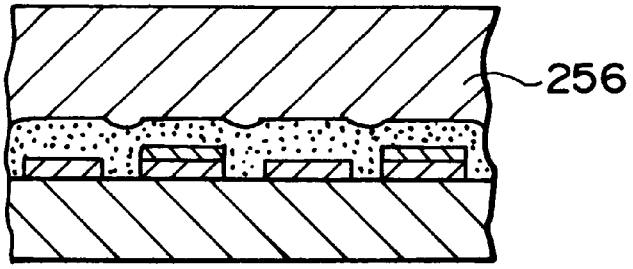
FIG. 9(a) PRIOR ART
FIG. 9 illustrates manufacturing steps of liquid jet head.
Figure 9B:
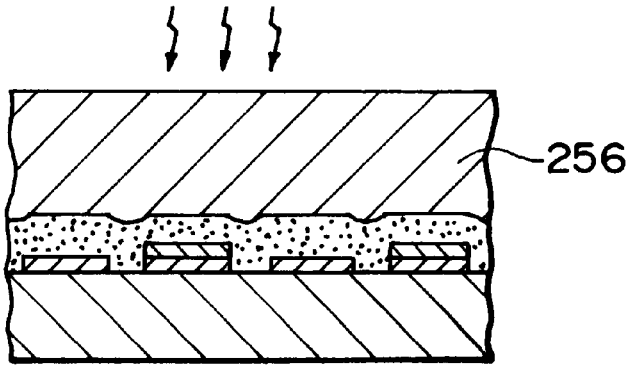
FIG. 9(b) PRIOR ART
Figure 9C:
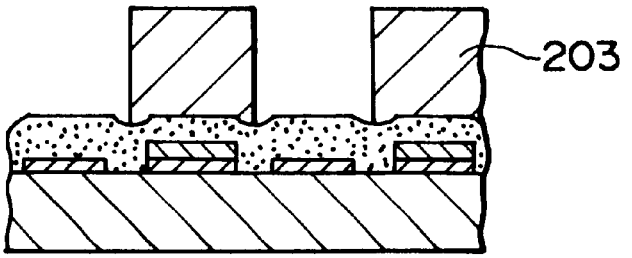
FIG. 9(c) PRIOR ART
Figure 9D:
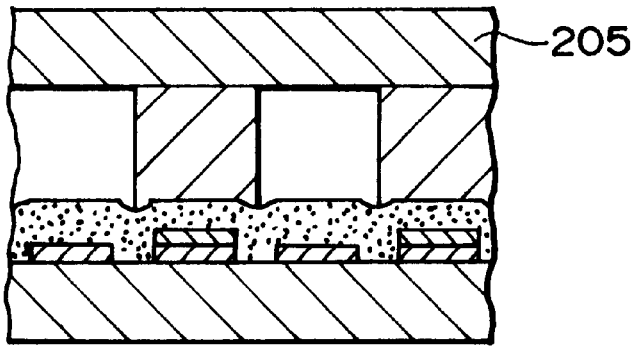
FIG. 9(d) PRIOR ART

FIG. 5 is a perspective view illustrating the outer construction of an ink jet recording apparatus. In FIG. 5, an ink jet recording head 1 is responsive to a recording signal supplied from driving signal supplying means provided in the main assembly of the recording apparatus, to eject the ink to record a desired image. The recording head 1 is carried on a carriage 2 which scanningly moves along the main scan direction. The carriage 2 is slidably supported on guiding shafts 3 and 4, and reciprocates in the main scan direction with the motion of the timing belt 8. The timing belt 8 engaged with the pulleys 6 and 7 is driven by a carriage motor 5 through a pulley 7.

The recording paper 9 is guided by a paper pan 10, and is fed by a sheet feeding roller (not shown) press-contacted thereto. The feeding of the sheet is effected by a sheet feeding motor 15. The fed recording sheet 9 receives tension force by the discharging roller 13 and spur 14, and is press-contacted to a heater 11 by a sheet confining plate 12 by the elastic member. Therefore, it is fed while being closely contacted to the heater. The recording sheet 9 now receiving the ink ejected from the recording head 1 is heated by the heater 11, so that the water content of the ink deposited thereon is evaporated, and therefore, the ink is fixed on the recording sheet 9.

A recovery unit 15 functions to remove high viscosity ink or foreign matter deposited on the ejection side surface (not shown) of the recording head to recovery the regular ejection property of the recording head.

A cap 18*a* is a part constituting a recovery system unit 15, and it caps the ejection outlets of the ink jet recording head 1 to protect the clogging thereof. An ink absorbing material 18 is disposed in the cap 18*a*.

In the recording region side of the recovery unit 15, there is provided a cleaning blade 17 for contact with the surface having the ejection outlets of the recording head 1 to remove the foreign matter and ink droplet deposited on the ejection side surface.

The liquid jet head thus produced starts uniform bubble formation upon the ink ejection, without bubble creation at four corners (H in the Figure) of the heat generating resistor. Therefore, the variations of the ejection speeds of the ejected droplets can be reduced, and in addition, the heat spot of the heat generating resistor can be removed, so that the maximum temperature can be reduced. This is effective to expand the service life.

The above-described advantageous effects, are more remarkable in the case that the ratio of the length of the heat generating resistor (measured in a direction in which the wiring electrodes are opposed) and the width thereof is close to 1 (particularly not more than 1.2), or in the case where the protection layer is thin or in the case where the protection layer is not provided.

While the invention has been described with reference to the structures disclosed herein, it is not confined to the details set forth and this application is intended to cover such modifications or changes as may come within the purposes of the improvements or the scope of the following claims.

What is claimed is:

1. A substrate for a recording head, comprising:

a heat generating resistor for generating thermal energy to eject a liquid; and a pair of opposed electrodes which are electrically connected to said heat generating resistor to supply an electric signal to said heat generating resistor, wherein a portion of said heat generating resistor interposed between said electrodes constitutes a heat generating portion, wherein said electrodes have respective ends adjacent to said heat generating resistor, and each of said ends is contacted to said heat generating resistor, and a portion thereof contacted to said heat generating resistor is configured into a smooth continuous convex shape without a concave portion and without an angled portion, and wherein a width of a pattern constituting said heat generating resistor is greater than a width of a pattern constituting said electrodes, and said heat generating resistor and said pair of electrodes have different patterns and are patterned separately.

2. A substrate according to claim 1, wherein each of said ends has a lateral side, and each of said lateral sides of ends has a convex shape.

3. A substrate according to claim 1, wherein the convex shape of each of the lateral sides has a radius of curvature which is smaller than a radius of curvature of said convex shape at said end.

4. A substrate according to claim 1, wherein said smooth convex shape has a central straight portion.

5. A liquid jet recording apparatus, comprising:

a substrate including a heat generating resistor for generating thermal energy to eject a liquid, a pair of opposed electrodes which are electrically connected to said heat generating resistor to supply an electric signal to said heat generating resistor, wherein a portion of said heat generating resistor interposed between said electrodes constitutes a heat generating portion, wherein said electrodes have respective ends adjacent to said heat generating resistor, and each of said ends is contacted to said heat generating resistor, and a portion thereof contacted to said heat generating resistor is configured into a smooth continuous convex shape without a concave portion and without an angled portion, an ejection outlet for ejecting the liquid; and a passage in fluid communication with said ejection outlet, wherein said heat generating portion is disposed in said passage, wherein a width of a pattern constituting said heat generating resistor is greater than a width of a pattern constituting said electrodes, each of said ends is configured into a smooth continuous convex shape without a concave portion and without an angled portion, and said heat generating resistor and said pair of electrodes have different patterns and are patterned separately.

6. A recording apparatus according to claim 5, wherein each of said ends has a lateral side, and each of said lateral sides of ends has a convex shape.

7. A recording apparatus according to claim 5, wherein the convex shape of each of the lateral sides has a radius of curvature which is smaller than a radius of curvature of said convex shape at said end.

8. A recording apparatus according to claim 5, wherein said smooth convex shape has a central straight portion.

9. A liquid jet recording apparatus, comprising:

a substrate including a heat generating resistor for generating thermal energy to eject a liquid, a pair of opposed electrodes which are electrically connected to said heat generating resistor to supply an electric signal to said heat generating resistor, wherein a portion of said heat generating resistor interposed between said electrodes constitutes a heat generating portion, wherein said electrodes have respective ends adjacent to said heat generating resistor, and each of said ends is contacted to said heat generating resistor, and a portion thereof contacted to said heat generating resistor is configured into a smooth continuous convex shape without a concave portion and without an angled portion, an ejection outlet for ejecting the liquid;

a passage in fluid communication with said ejection outlet, wherein said heat generating portion is disposed in said passage; and signal supplying means for supplying the electric signal, wherein a width of a pattern constituting said heat generating resistor is greater than a width of a pattern constituting said electrodes, and said heat generating resistor and said pair of electrodes have different patterns and are patterned separately.

10. A recording apparatus according to claim 9, wherein each of said ends has a lateral side, and each of said lateral sides of ends has a convex shape.

11. A recording apparatus according to claim 9, wherein the convex shape of each of the lateral sides has a radius of curvature which is smaller than a radius of curvature of said convex shape at said end.

12. A recording apparatus according to claim 9, wherein said smooth convex shape has a central straight portion.

13. A liquid jet recording apparatus, which includes a substrate having a heat generating resistor for generating thermal energy to eject a liquid, a pair of opposed electrodes which are electrically connected to said heat generating resistor to supply an electric signal to said heat generating resistor, wherein a portion of said heat generating resistor interposed between said electrodes constitutes a heat generating portion, wherein said electrodes have respective ends adjacent to said heat generating resistor, and an ejection outlet for ejecting the liquid, and a passage in fluid communication with said ejection outlet, wherein said heat generating portion is disposed in said passage, the improvement comprising:

said heat generating resistor and said pair of electrodes have different patterns;

a width of a pattern constituting said heat generating resistor is greater than a width of a pattern constituting said electrodes;

each of said ends is contacted to said heat generating resistor, and a portion thereof contacted to said heat generating resistor is configured into a smooth continuous convex shape without a concave portion and without an angled portion; and said heat generating resistor and said pair of electrodes are patterned separately.

* * * * *

UNITED STATES PATENT AND TRADEMARK OFFICE

CERTIFICATE OF CORRECTION

PATENT NO. : 6,139,130
DATED : October 31, 2000
INVENTOR(S) : Hiroto Takahashi et al.

It is certified that error appears in the above-identified patent and that said Letters Patent is hereby corrected as shown below:

Column 1,
Line 11, "erecting" should read -- ejecting --;
Line 39, "FIG. 6(a-e) shows" should read -- FIGS. 6(a-e) shown --;
Line 50, "(stop (c)-step 8(b)." should read -- step 6(c)-step8(b)). --; and
Line 55, "(step (d))," should read -- (step 6(d)), --.

Column 2,
Line 23, "problem" should read -- problems --.

Column 3,
Line 8, "can not" should read -- cannot --;
Line 39, "is excessive" should read -- are excessively --; and
Line 50, "portion" should read -- portions --.

Figure 10A:
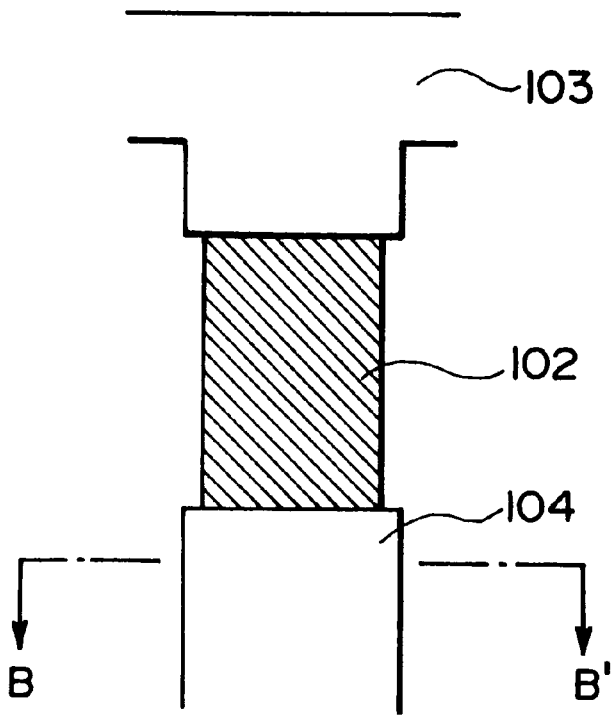
FIG. 10A PRIOR ART
FIG. 10 illustrates structure of electrothermal transducer of a thermal head.
Figure 10B:
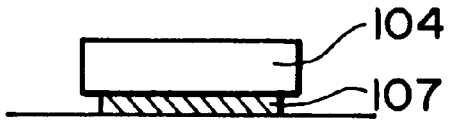
FIG. 10B PRIOR ART
Figure 11A:
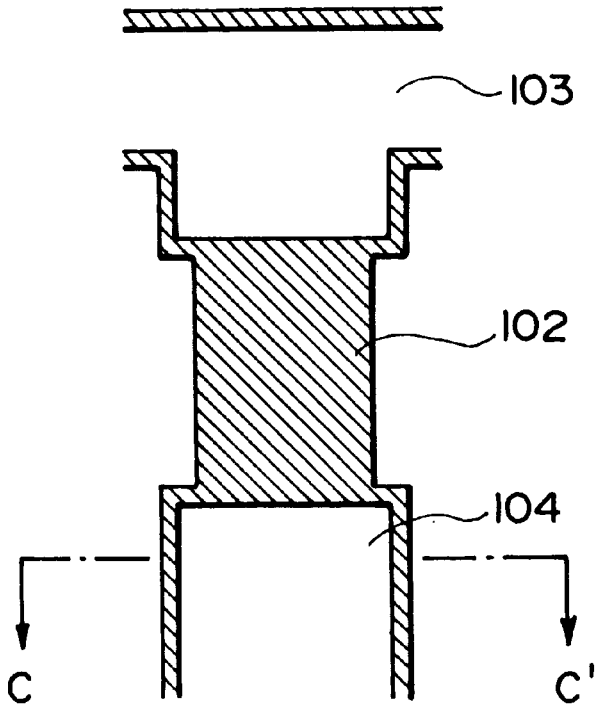
FIG. 11A PRIOR ART
FIG. 11 shows a structure of electrothermal transducer element of a liquid jet recording head.
Figure 11B:
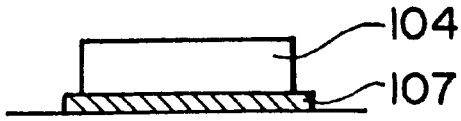
FIG. 11B PRIOR ART
Figure 12:
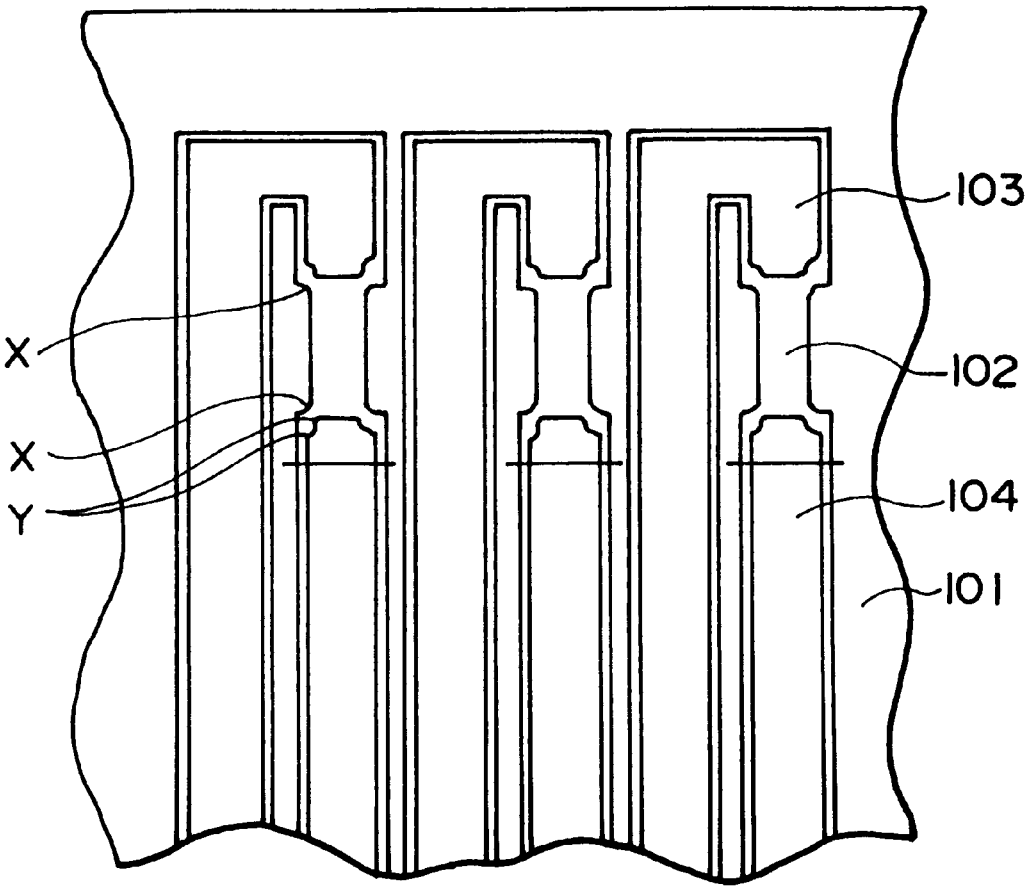
FIG. 12 PRIOR ART
FIG. 12 illustrates a structure of an electrothermal transducer element of a liquid jet recording head.

Column 4,
Line 59, "FIG. 6 illustrates" should read -- FIGS. 6(a-e) illustrate --;
Line 60, "FIG. 7 illustrates" should read -- FIGS. 7(a-d) illustrate --;
Line 61, "FIG. 8 illustrate" should read -- FIGS. 8(a-d) illustrate --;
Line 63, "FIG. 9 illustrates" should read -- FIGS.9(a-d) illustrate --;
Line 64, "FIG. 10 illustrates" should read -- FIGS. 10A and 10B illustrate the -- ; and "electrothermal" should read -- an electrothermal --; and
Line 66, "FIG. 11 shows a" should read -- FIGS. 11A and 11B show the --; and "electrothermal" should read -- an electrothermal --.

Column 5,
Line 59, "40$\mu$m" should read -- 40$\mu$m, --.

Column 6,
Line 44, "a" should be deleted; and
Line 45, "practical" should read -- a practical --.

UNITED STATES PATENT AND TRADEMARK OFFICE

CERTIFICATE OF CORRECTION

PATENT NO. : 6,139,130
DATED : October 31, 2000
INVENTOR(S) : Hiroto Takahashi et al.

It is certified that error appears in the above-identified patent and that said Letters Patent is hereby corrected as shown below:

Column 7,
Line 32, "recovery" should read -- recover --.

Signed and Sealed this

Fifth Day of March, 2002

*Attest:*

*Attesting Officer*

JAMES E. ROGAN
*Director of the United States Patent and Trademark Office*